United States Patent [19]

Tash

[11] Patent Number: 4,606,364

[45] Date of Patent: Aug. 19, 1986

[54] FLUSHING DEVICE ADAPTER

[76] Inventor: George Tash, 19438 Business Ctr. Dr., Northridge, Calif. 91324

[21] Appl. No.: 656,344

[22] Filed: Oct. 1, 1984

[51] Int. Cl.[4] ..... B08B 9/02

[52] U.S. Cl. ..... 134/167 C; 137/799; 137/853; 285/8; 285/107

[58] Field of Search ..... 285/8, 107, 109, 260, 285/423; 4/256, 257; 134/166 C, 167 C, 169 C; 137/843, 853, 799

[56] References Cited

U.S. PATENT DOCUMENTS

| | | | |
|---|---|---|---|
| 1,988,198 | 1/1935 | German | 285/8 X |
| 2,001,230 | 5/1935 | Wayne | 4/256 |
| 2,061,553 | 11/1936 | Acosta | 285/107 |
| 3,535,161 | 10/1970 | Gutrich | 134/167 C X |
| 3,792,708 | 2/1974 | Tash | 137/843 X |
| 4,129,324 | 12/1978 | Jones | 285/107 |
| 4,475,255 | 9/1984 | Tash | 4/256 |

FOREIGN PATENT DOCUMENTS

| | | | |
|---|---|---|---|
| 114938 | 3/1942 | Australia | 285/107 |
| 88817 | 3/1937 | Sweden | 4/256 |
| 549361 | 11/1942 | United Kingdom | 285/107 |

*Primary Examiner*—Dave W. Arola

*Attorney, Agent, or Firm*—John J. Posta, Jr.

[57] ABSTRACT

An adapter to be used in conjunction with a tubular flushing device to unclog a drain pipe. The tubular flushing device expands during usage. The tubular flushing device is to fit within the adapter and is to expand during usage into tight contact with the interior wall of the adapter. The fore end of the adapter is tapered slightly to facilitate tight connection with the inlet opening of the drain pipe.

6 Claims, 4 Drawing Figures

FLUSHING DEVICE ADAPTER

BACKGROUND OF THE INVENTION

Drain pipes are in common use within homes and buildings for disposing of a combined mixture of liquid and solid matter. The common form of such drain pipes are pipes that are used in conjunction with kitchen sinks, bathtubs, showers, washing machines, etc.

Drain pipes at times may become clogged with a solid or semi-solid material which causes a stoppage of normal flow through the drain pipe. It is necessary to clear the drain pipe of the clog in order for the drain pipe to work satisfactorily.

In the past, a common way in which drain pipes are unclogged is by contacting a service wherein a person, specialized in unclogging drains, travels to the drain location and utilizes some form of rotating mechanical cutting device within the drain pipe in order to unclog the pipe. This type of service is exceedingly effective in achieving unclogging of the drain pipe. However, because of the time and equipment involved, the service has one main drawback in that it is expensive.

At times the clogging of the drain may only be due to a minor problem that can be corrected without the requiring of hiring of a service. For such types of clogged drains, it is common to use some type of a chemical which would be poured down the drain and is designed to "eat" away at the clogged material until such is dissolved and the drain operates satisfactorily. However, such chemicals have to be manufactured to be minimally toxic to minimize contamination within the sewage system. As a result, chemicals which are designed to unclog drains only work on a drain that is very minorly clogged.

Another type of drain unclogger is a flexible wire, a few feet in length, which the user can force into the drain pipe. However, if the clog is beyond the length of the wire, the wire is not effective. Additionally, most drains have one or more bends and it is difficult to have the flexible wire traverse more than one bend.

A still further device which is usable to unclog drains comprises that of an elastomeric tube which has a small orifice in its free end with the back end having an attachment to facilitate connection to a garden hose. The elastomeric tube is to be inserted within the drain pipe. Upon flow of water being conducted through the garden hose, the elastomeric tube is expanded against the inner wall of the drain pipe, to be securely held in place, with the water then being pulsingly dispensed from the small orifice in the free end of the elastomeric tube. These pulsing jets of water are designed to create sufficient pressure and flow volume to force the foreign material forming the clog along the drain pipe until the drain pipe is cleared.

The common design of drain pipes is to utilize a strainer directly adjacent the inlet opening to the drain pipe. The purpose of the drain strainer is to prevent larger size solid matter from being accidentally discharged into the drain pipe. Common forms of larger sized solid matter would be marbles, rings, etc.

Because of such drain strainers, it is not possible to insert the elastomeric tubular member a sufficient distance within the drain pipe in order to operate satisfactorily. It would be desirable to design some form of adapter which could be used to permit the operation of an expanding elastomeric tube in conjunction with drain pipes which have drain strainers so that such a device could be utilized to unclog such a type of drain pipe. The usage of such elastomeric tubes is found to be far more effective in removing clogged drain pipes than both chemicals and wire devices which are constructed only of a few feet in length.

SUMMARY OF THE INVENTION

The structure of the present invention is directed to an adapter which is to be utilized in conjunction with an expandable tubular flushing device to unclog a drain pipe. The adapter includes an annular section at its free outer end which is to tightly fit with the wall of the inlet opening of the drain pipe forming a liquid tight connection therebetween. The adapter is entirely hollow with there being an enlarged chamber formed within the wall of the adapter between its free out end and its aft end. An expandable elastomeric tubular flushing device is to be readily insertable through the aft end within the adapter so that the forward end of the tubular flushing device connects with the enlarged section. There is formed on the exterior surface of the tubular flushing device a plurality of annular ridges which in turn are to connect with a plurality of annular grooves formed within the wall of the internal chamber of the adapter. Upon water flowing through the tubular flushing device, the tubular flushing device will expand and form a liquid tight connection with the adapter. The connection between the ridges and the grooves as well as the enlargement of the forward end of the tubular flushing device into the enlarged section will prevent the tubular flushing device from withdrawing from the adapter. The user is to physically hold the adapter into liquid tight connection with the drain pipe.

DETAILED DESCRIPTION OF THE SHOWN EMBODIMENT

Figure 1:
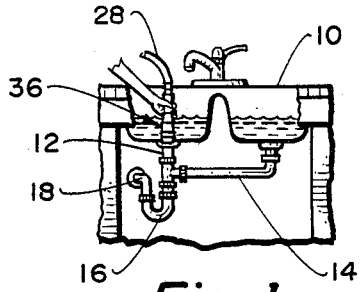
FIG. 1 is a diagrammatic view showing the use of the adapter of the present invention in conjunction with an expanded elastomeric tubular flushing device in order to remove a clog within a conventional sink.
Figure 2:
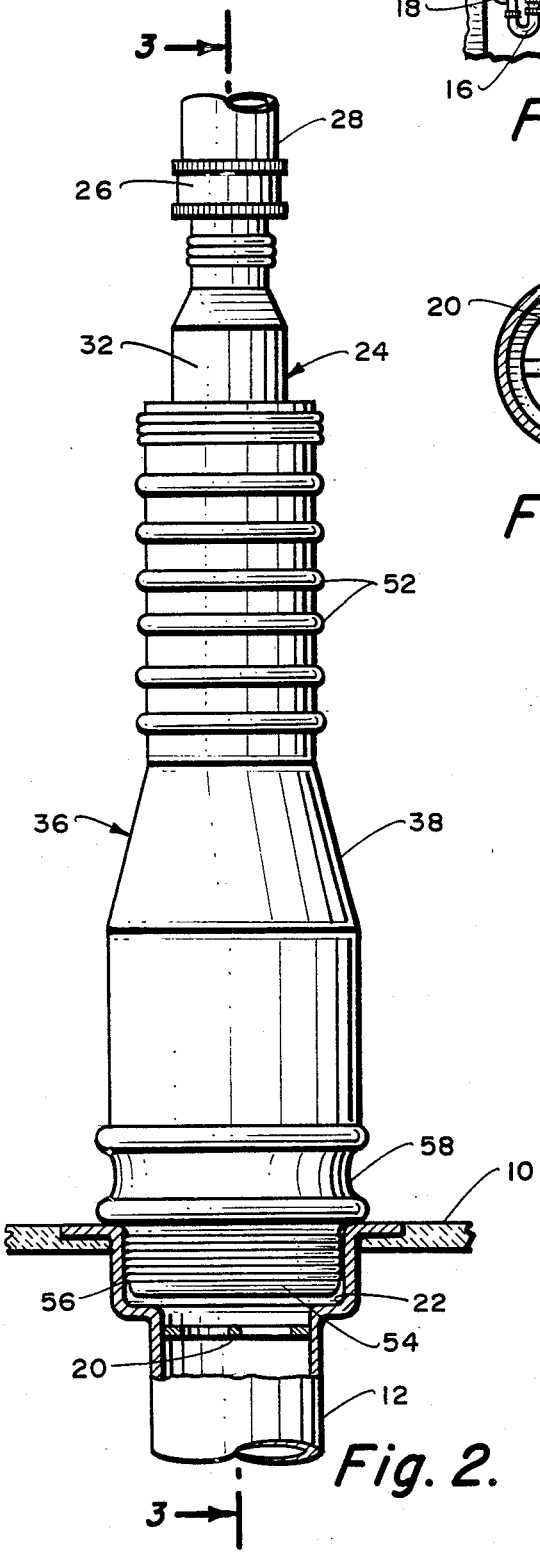
FIG. 2 is a side elevational view showing connection of the adapter of the present invention with the inlet opening of a conventional drain pipe of a sink.
Figure 4:
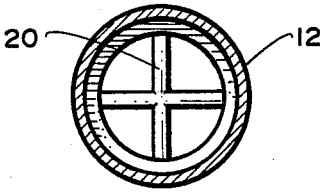
FIG. 4 is a cross-sectional view through a portion of the drain pipe taken along line 4—4 of FIG. 3 showing a conventional drain strainer which is fixedly mounted within the drain pipe.

Referring particularly to the drawings, there is shown in FIG. 1 a conventional sink assembly 10 which is generally referred to as a double sink. The double sinks include drain pipes 12 and 14 which are to deposit waste water within a trap conduit 16. From the trap conduit 16 the waste water is discharged through an outlet pipe 18 to be then deposited at a location spaced from the sink assembly 10. A typical location would be a sewer.

Mounted within the drain pipe 12 is a drain strainer 20. Drain strainer 20 generally comprises no more than a pair of rod-like cross-members which are integrally mounted to the wall of the drain pipe 12 directly adjacent the inlet opening 22 of the pipe 12.

A desirable way to remove a clog within the drain pipe 12 would be to use a flushing device 24. Flushing device 24 is deemed to be conventional with such a flushing device being described within the U.S. Pat. No. 3,792,708 issued Feb. 19, 1974. Flushing device 24 includes a hose connector 26 which is to connect to a conventional garden hose 28. Flushing device 24 terminates at its outer end in a metallic sleeve 30. In between the connector 26 and the sleeve 30 is a tubular elastomeric (preferably rubber) body 32. The sleeve 30 is swaged onto the outer end of the body 32 onto a valve assembly 31 which is mounted within the tubular body 32. Located on the exterior surface of the body 32 are a plurality of evenly spaced-apart annular ridges 34. The function of the ridges 34 will be explained further on in this specification.

Figure 3:
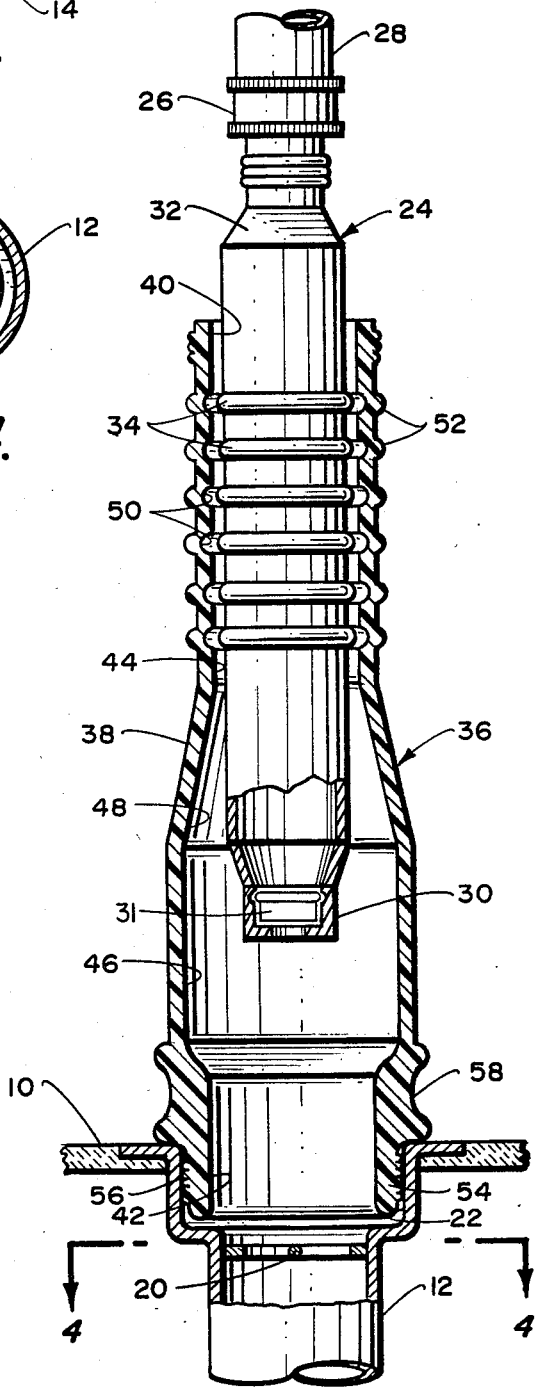
FIG. 3 is a cross-sectional view taken along line 3—3 of FIG. 2 showing the internal construction of the adapter of the present invention plus showing an elastomeric expandable tubular flushing device located within the adapter.

It is to be understood that by applying water under pressure through the garden hose 28 to within the body 32 will cause the elastomeric body 32 to expand as shown in the dotted line position within FIG. 3 of the drawings. Because of the valve formed within the body 32, the water contained within the body 32 is emitted from the flushing device 24 exteriorly of the sleeve 30 in the form of a series of pulses. The purpose of the pulsing, is to apply rapid series of spurts of water onto a clog within the drain pipe 12 in order to make the flushing device 24 more effective than just applying a steady stream of water.

Body 32 of the flushing device 24 is designed in its relaxed or unexpanded state to slide within the drain pipe 12. If it were not for the drain strainer 20, this would be the normal manner in which the flushing device 24 would be used with it being completely submerged within the drain pipe 12. However, the location of the drain strainer 20 prevents such insertion. Therefore, the adapter 36 of the present invention is to be used in order to permit use of the flushing device 24 in conjunction with the drain pipe 12 which includes a drain strainer 20.

The adapter 36 comprises body 38 formed of rigid material such as plastic or the like. The aft end of the body 38 includes the entry opening 40 and the fore end of the body 38 includes the exit opening 42. Located between the openings 40 and 42 is an internal chamber which includes a smaller diametered section 44 and an enlarged diametered section 46. A tapered wall 48 connects the enlarged diametered section 46 to the smaller diametered section 44.

Formed within the interior wall of the smaller diametered section 44 are a plurality of evenly spaced-apart annular grooves 50. The grooves 50 result in a plurality of annular spaced-apart protrusions 52 on the exterior surface of the body 38. It is to be noted that the spacing of the grooves 50 is identical to the spacing of the ridges 34. Also, the size of each of the grooves 50 is approximately equal to the size of each of the ridges 34.

Located about the exit opening 42 is an annular section 54. Annular section 54 has an exterior surface which is slightly tapered to be slightly smaller in diameter as its outermost portion. Formed within the exterior wall of the section 54 are a series of ridges 56.

Formed within the exterior wall of the body 38 directly adjacent the section 54 is an annular recess 58. The recess 58 functions as a strengthening recess to provide rigidity to the body 38.

In operation, the operator manually grasps the exterior of the body 38 and places section 54 within drain inlet opening 22. The ridges 56 are for the purpose of facilitating tight connection with the inlet opening 22. Also, the slight tapering of the exterior wall section 54 is for the purpose of facilitating liquid tight connection with the opening 22.

The operator then locates the flushing device 24 within the internal chamber. This location is such that the sleeve 30 extends partially within the enlarged chamber 46 and also so that each ridge 34 is located directly adjacent a corresponding groove 50. It is assumed that the garden hose 28 has been previously connected to the connection 26. Upon applying of water to the flushing device 24, the body 32 will expand so that the ridges 34 come to rest within the grooves 50. Also, the portion of the body 32 which is located directly adjacent the sleeve 30 will expand against the tapered wall 48. At this particular time, pulse jets of water are being supplied into the drain pipe 12 at a rather rapid rate. The valve flushing device 24 is forced outward into tight contact with the adapter 36 with withdrawal being prevented due to the connection between the ridges 34 and the grooves 50 and also because the forwardmost section of the body 32 has expanded against the tapered wall 48. The pulse jets of water pass through the enlarged section 46, through the exit opening 42 and into the drain pipe 12.

The user is to manually maintain the connection between the adapter 36 and the drain pipe 12. In order to facilitate this manual connection the annular protrusions 52 provide a frictional resistance in applying the necessary pressure of the adapter 36 into the drain inlet 22. Also, the exterior enlarging of the body 32, due to the forming of enlarged section 46, facilitates the manual applying of the necessary pressure.

What is claimed is:

1. A drain flushing assembly, comprising (a) a flushing device having
  (1) an elongated, elastomeric, hollow tubular member having
    (i) a middle portion free to expand radially under water pressure,
    (ii) a rear inlet end fitted with a hose connection,
    (iii) a front outlet end, and
    (iv) a valve member secured within said outlet end which is openable upon expansion of said middle portion, and (b) an adapter for releasably interconnecting said tubular member to a drain pipe which contains an obstruction therein preventing insertion of said middle portion into said drain pipe, said adapter comprising,
  (1) an elongated tubular member having
    (i) an inlet end adapted to receive the outlet end of said flushing device,
    (ii) an outlet end adapted to be inserted into said drain pipe to form a water-tight seal with said drain pipe, and
    (iii) a hollow intermediate portion connecting said inlet and outlet ends of said adapter, and (c) mating means disposed on the outside of said flushing device and the inside of said adapter for preventing withdrawal of said flushing device from said adapter during use of said flushing assembly.

2. The drain flushing assembly of claim 1 wherein said mating means includes, (1) a plurality of radially extending protrusions on the outside of said middle portion of the flushing device, and (2) a plurality of recesses on the inside of the inlet end of the adapter, (3) wherein said protrusions and recesses are complimentary and adapted to mate with one another.

3. The drain flushing assembly of claim 2 wherein said adapter is made from a rigid material.

4. An adapter for releasably interconnecting a flushing device to a drain pipe wherein said flushing device has a rear inlet end fitted with a hose connector, a front outlet end with a valving member disposed therein, and a middle portion free to expand radially under water pressure, wherein said drain pipe has an obstruction therein preventing insertion of said middle portion into said drain pipe, said adapter comprising:

(a) an elongated tubular member having, (i) an inlet end adapted to receive the outlet end of said flushing device, (ii) an outlet end having an outside diameter substantially the same as the inside diameter of the drain pipe, and adapted to be inserted into said drain pipe to form a water-tight seal, (iii) a hollow intermediate portion connecting said inlet and outlet ends of the adapter, and (iv) mating means disposed on the inside of the adapter's inlet end adapted to mate with and releasably retain therein the outlet end of the flushing device when said middle portion is expanded under water pressure.

5. The adapter of claim 4 wherein said middle portion of the flushing device has a plurality of protrusions extending radially from the surface thereof and wherein said mating means disposed on the inside of the adapter's inlet end comprise a plurality of recesses adapted to releasably receive said protrusions.

6. The adapter of claim 5 wherein said adapter is made from a rigid material.

* * * * *